US008641841B2

(12) United States Patent
Tatsuoka et al.

(10) Patent No.: US 8,641,841 B2
(45) Date of Patent: Feb. 4, 2014

(54) CONTINUOUS HEAT TREATMENT FURNACE AND UTILIZING THE SAME, METAL TUBE AND HEAT TREATMENT METHOD

(75) Inventors: Mikio Tatsuoka, Hyogo (JP); Akhiro Sakamoto, Chiba (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 396 days.

(21) Appl. No.: 12/651,064

(22) Filed: Dec. 31, 2009

(65) Prior Publication Data

US 2010/0156011 A1 Jun. 24, 2010

Related U.S. Application Data

(60) Division of application No. 12/019,424, filed on Jan. 24, 2008, now abandoned, which is a continuation of application No. PCT/JP2005/013573, filed on Jul. 25, 2005.

(51) Int. Cl.
*F27B 9/28* (2006.01)

(52) U.S. Cl.
USPC ..... 148/591; 148/121; 148/194; 148/639; 432/4; 432/5; 432/11; 432/56

(58) Field of Classification Search
USPC ..... 148/16, 591; 432/72, 64, 59
See application file for complete search history.

(56) References Cited

U.S. PATENT DOCUMENTS

| | | | | |
|---|---|---|---|---|
| 3,467,366 | A | | 9/1969 | Westeren et al. |
| 4,543,060 | A | | 9/1985 | Bowes |
| 4,746,289 | A | * | 5/1988 | Guillaume ..... 432/8 |
| 5,800,774 | A | * | 9/1998 | Willett ..... 266/105 |

FOREIGN PATENT DOCUMENTS

| | | | | |
|---|---|---|---|---|
| FR | 819439 | A | | 10/1937 |
| JP | 51-122608 | A | | 10/1976 |
| JP | 52-035110 | A | | 3/1977 |
| JP | 05-320745 | A | | 12/1993 |
| JP | 06-128645 | A | | 5/1994 |
| JP | 2004-239505 | | * | 8/2004 |
| JP | 2004-239505 | A | | 8/2004 |
| JP | 2005-213645 | A | | 8/2005 |
| JP | 2005-307273 | A | | 11/2005 |

OTHER PUBLICATIONS

European Search Report for PCT/JP2005/013573, dated Nov. 26, 2009.

* cited by examiner

*Primary Examiner* — Melvin C Mayes
*Assistant Examiner* — Colette Nguyen
(74) *Attorney, Agent, or Firm* — Marshall, Gerstein & Borun LLP

(57) ABSTRACT

A continuous heat treatment furnace is provided in which an atmosphere-control gas is introduced to a heating chamber having a heating zone, metal tubes are continuously charged along an axial direction from a furnace entrance, and the metal tube subjected to a heat treatment is taken out from a furnace. The continuous heat treatment furnace includes a front chamber which has a preheating zone on an entrance side of the heating chamber and seal curtains which are located on an entrance side and an exit side of the front chamber.

3 Claims, 5 Drawing Sheets

CONTINUOUS HEAT TREATMENT FURNACE AND UTILIZING THE SAME, METAL TUBE AND HEAT TREATMENT METHOD

This application is a Division of 12/019,424, filed Jan. 24, 2008, now abandoned which is a continuation of PCT/JP2005/013573.

TECHNICAL FIELD

The present invention relates to a continuous heat treatment for a cold-worked metal tube (pipe), particularly to a continuous heat treatment furnace which does not cause contamination on a metal tube, i.e., a stainless steel tube, which is cold-worked using rolling oil or lubricant containing a hydrocarbon component, from an emission gas generated by an adhered substance to an inner surface of a metal tube, and a metal tube subjected to a heat treatment using the continuous heat treatment furnace, and a heat treatment method.

BACKGROUND ART

In the case where the cold working is performed as a cold-worked metal tube, i.e., a cold-finished steel tube, a proper surface treatment is performed to inner and outer surfaces of the steel tube to process the steel tube to have predetermined dimensions such that the rolling oil is applied during cold rolling or such that the steel tube is coated with a lubricant (metal soap) for cold drawing.

In the case where the cold-worked steel tube is subjected to the heat treatment, it is necessary that the rolling oil or the lubricant be washed (degreased) to remove the adhered substance to the inner and outer surfaces of the steel tube before the heat treatment. When the heat treatment is performed while the adhered substance remains on the surface of the steel tube, because sometimes the rolling oil or the lubricant contains chlorine and the like in addition to the hydrocarbon component, the rolling oil or lubricant is evaporated during the heat treatment to generate contaminant gases such as a chlorine gas, which sometimes results in the contamination on the inner surface of the steel tube where the contaminant gas remains particularly easily.

Even if the evaporated gas does not contain the contaminant gases such as the chlorine, sometimes carburizing occurs depending on temperature conditions because the inner and outer surfaces of the steel tube are exposed to a high-temperature gas containing a carbon source. In the steel tube in which the carburizing occurs on the surface thereof, SCC (stress corrosion cracking) is possibly generated from the carburized portion when the steel tube is used repeatedly in high temperature and high pressure. Therefore, in the case where the cold-worked steel tube is subjected to the heat treatment, it is necessary that the carburizing does not occur on the inner and outer surfaces of the steel tube.

When the adhered substance remaining in the inner and outer surfaces of the steel tube is to be removed before the heat treatment lest the contamination or carburization be generated on the surfaces of the steel tube during the heat treatment, a process for cleaning the inner surface such as sandblasting is additionally required because the adhered substance cannot be removed only by alkali degreasing and washing after the cold working. When acid pickling is applied, man-hours increase. In any case, costs for producing the steel tube increase due to the cold working.

Because it is effective to replace the gas inside the tube with an atmosphere-control gas to prevent the contamination or carburizing on the inner surface of the steel tube, conventionally various countermeasures are proposed.

In a tube-inside gas purging apparatus disclosed in Japanese Patent Application Publication No. 5-320745, a pair of opening/closing doors with elastic pads as opposed to each other is provided so as to independently be movable upward or downward, at the entrance of a purging chamber, incoming straight tubes are tentatively halted at the entrance and are pinched by actuating the upper and the lower doors to thereby increase a pressure of the atmosphere-control gas in the purging chamber to replace the gas inside the straight tubes with the atmosphere-control gas.

However, in the apparatus disclosed in Japanese Patent Application Publication No. 5-320745, a heat treatment efficiency is remarkably decreased due to the need to stop feeding of the straight tubes at the entrance of the purging chamber each time. At the same time, the elastic pad in the heated atmosphere is terribly deteriorated, which results in a problem in that required performance is not achieved or the elastic pad needs to be frequently exchanged.

In a heat treatment apparatus disclosed in Japanese Patent Application Publication No. 6-128645, a loading table for feeding the straight tube toward the entrance of the straight tube is provided at a side portion of a heat treatment furnace for performing the heat treatment for the straight tube in an atmosphere-control gas, and a negative-pressure applying means is provided in the loading table. The negative-pressure applying means causes a negative pressure onto rear ends of the straight tubes while front ends of the straight tubes enter into and reside inside the heat treatment furnace. Therefore, purging operation into the inside of the straight tube is extremely easily performed.

However, in the apparatus disclosed in Japanese Patent Application Publication No. 6-128645, the needs for the large-capacity negative-pressure applying means requires large-scale facility investment, which unfortunately increases the cost for producing the steel tube.

Japanese Patent Application Publication No. 2004-239505 discloses a continuous heat treatment furnace characterized in that a heat-resistant curtain is provided in a furnace entrance so as to cover the whole surface of the furnace entrance therewith and the steel tube is fed through the heat-resistant curtain. In the heat treatment furnace, because a decomposed gas (contaminant gas) generated from the adhered substance to the inner surface of the steel tube likely reside inside the steel tube, the atmosphere-control gas is caused to migrate in to the inside of the steel tube from the front end thereof to create a significant gas flow inside the steel tube.

Specifically, in charging the steel tube to be heat-treated into the furnace, when by heating up, a surface temperature of the front end side of the steel tube that enters earlier reaches 200 to 600° C., the residual adhered substance is decomposed to generate the hydrocarbon gas and the like. Compared with the outside of the continuous heat treatment furnace, the positive pressure is established in the atmosphere-control gas of the furnace by covering the furnace entrance to seal the furnace, desirably by covering opposite ends of the furnace, i.e., the furnace entrance and the furnace exit portion. Therefore, the gas flow can be created from the front end toward the rear end of the steel tube.

Accordingly, in charging the steel tube into the heat treatment furnace, the flow of the atmosphere-control gas is created from the front end toward the rear end of the steel tube while the adhered substance remaining the inner surface is decomposed and removed, so that the atmosphere-control gas can easily replace the gas inside the steel tube and the contamination or carburizing attributable to the decomposed gas of the adhered substance can be prevented without decreasing the heat treatment efficiency.

However, in the heat treatment furnace disclosed in Japanese Patent Application Publication No 2004-239505, when the rear end of the steel tube to be heat-treated enters the furnace (exactly, inside of the heat-resistant curtain), a pressure difference is diminished between the front end and rear end of the steel tube to stop the gas flow inside the steel tube, and the hydrocarbon gas or contaminant gas likely remains near the rear end. Therefore, it is necessary that the temperature be always controlled at the entrance of the furnace such that the entrance of the furnace becomes the temperature at which the adhered substance to the inner surface of the steel tube can be decomposed before the rear end of the steel tube enters the inside of the heat-resistant curtain. Therefore, there is the need of the heat treatment furnace in which the hydrocarbon gas or contaminant gas can surely be removed by a facile method.

DISCLOSURE OF THE INVENTION

In view of the problem in relation to the adhered substance remaining on the inner and outer surfaces of the cold-worked steel tube and other metal tubes, an object of the present invention is to provide: a continuous heat treatment furnace which can easily remove the residual adhered substance before the heat treatment without decreasing the heat treatment efficiency even if the post-cold working washing process is performed only by the alkali degreasing and washing; a metal tube subjected to the heat treatment using the continuous heat treatment furnace; and a heat treatment method.

In order to solve the problems, the inventors made various investigations on the heat treatment method for removing the adhered substance remaining on the surface after washing the cold-worked steel tube. As a result, the inventors have found that, even if the post-cold working washing process is performed only by alkali degreasing and washing, the adhered substance remaining on the inner and outer surfaces can easily be decomposed, vaporized, and removed in charging the steel tube into the heat treatment furnace.

When the adhered substances (such as the rolling oil during the cold working and the lubricant (metal soap) for the drawing) remaining on the surface of the steel tube after the alkali degreasing and washing are heated to a temperature ranging from 200 to 600° C. during the heat treatment, almost all the adhered substances are decomposed to generate the hydrocarbon gas (in addition, other contaminant gas such as chlorine). In particular, the generation of the hydrocarbon type gas or the like becomes most significant at the temperature of 400° C. Therefore, in order to effectively decompose the residual adhered substance, it is desirable to heat the steel-tube surface to a temperature of 400° C. or more.

Usually, in the steel tube charged in the heat treatment furnace, the decomposed gas of the adhered substance to the inner surface likely remains inside the steel tube while the decomposed gas of the adhered substance to the outer surface is easily diffused by the surrounding gas flowing in the furnace. Sometimes the decomposed gas of the adhered substance contains the contaminant such as chlorine, and the hydrocarbon type gas has the carburizing ability. Therefore, sometimes the contamination or carburizing is generated on the steel-tube surface when the steel tube is heated to 800° C. or more.

Accordingly, in order to effectively prevent the generation of the contamination or carburizing, it is necessary that the temperature of the steel-tube surface be controlled to be lower than 800° C. In the actual operating furnace, it is desirable that the steel-tube surface be controlled to be not more than 750° C. in consideration of control accuracy of in the continuous heat treatment furnace.

Because the decomposed (contaminant gas) gas generated by the adhered substance to the inner surface of the steel tube likely remains inside the steel tube, the inventors made various investigations on a method for causing the gas to significantly flow inside the steel tube. As a result, the inventors has confirmed that the adhered substance to the inner surface of the steel tube is decomposed and removed easily and surely with no need to always control the temperature of the furnace entrance in such a manner that a front chamber including a preheating zone on the entrance side of the heating chamber of the continuous heat treatment furnace while the seal curtain is attached onto an exit side of the front chamber (i.e., the entrance side of the heating chamber) to set the internal pressure in the front chamber in the range of a "furnace external pressure or more to a heating chamber pressure or less", namely, the adhered substance is decomposed and removed easily and surely by providing a stepwise pressure difference in the heat treatment furnace.

The present invention is made based on the above findings, and the present invention mainly pertains to (1) a continuous heat treatment furnace, (2) a metal tube, and (3) a heat treatment method.

(1) A continuous heat treatment furnace in which an atmosphere-control gas is introduced to a heating chamber having a heating zone, metal pipes are continuously charged along an axial direction from a furnace entrance, and the metal tube subjected to a heat treatment is discharged from a furnace exit, the continuous heat treatment furnace being characterized by comprising: a front chamber which has a preheating zone on an entrance side of the heating chamber; and seal curtains which are located on an entrance side and an exit side of the front chamber.

Preferably the continuous heat treatment furnace further includes a rear chamber which is located on an exit side of the heating chamber; and seal curtains which are located on an entrance side of the rear chamber.

(2) A metal tube produced by the continuous heat treatment furnace described in (1).

(3) A heat treatment method in which an atmosphere-control gas is introduced to a heating chamber having a heating zone, metal pipes are continuously charged along an axial direction from a furnace entrance, and the metal tube subjected to a heat treatment is taken out from a furnace exit, the heat treatment method includes: setting an internal pressure of a front chamber including a preheating zone on an entrance side of the heating chamber in the range of a furnace external pressure or more to a heating chamber pressure or less; and performing the heat treatment for the metal tube by heating the metal tube to a temperature at which an adhered substance remaining on inner and outer surfaces of the metal tube can be vaporized in the front chamber.

As used herein, "vaporization of an adhered substance" shall mean that the adhered substance is decomposed to generate the hydrocarbon type gas or the like.

BRIEF DESCRIPTION OF THE DRAWINGS

FIG. 2A shows the case in which eight sheets of seal curtains (four sheets per set×two sets), and FIG. 2B shows 16 sheets of seal curtains (four sheets per set×four sets).

BEST MODE FOR CARRYING OUT THE INVENTION

As described above, in the present invention, the front chamber including the preheating zone is provided on the entrance side of the heating chamber, and the seal curtains are attached to the front chamber. It is checked whether or not the application of the stepwise pressure to the inside of the heat treatment furnace by the method should cause any problem.

Figure 1:
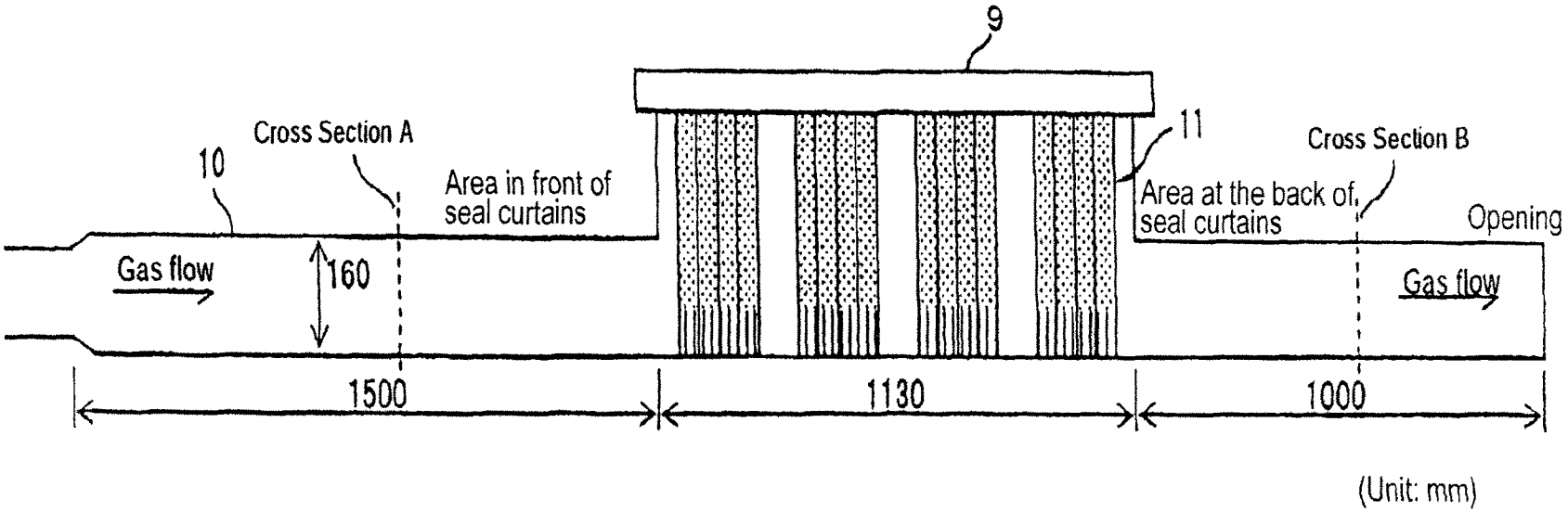
FIG. 1 shows a schematic configuration of a main part of a sealing performance test apparatus.

A sealing performance test apparatus shown in FIG. 1 is used for the checking. The apparatus has a duct (sectional shape: height 160 mm×width 800 mm) including a seal curtain attaching part 9 in a length-wise middle region thereof, seal curtains 11 are attached to the seal curtain attaching part 9, and gas (air is used) is supplied into the duct 10 with a supply amount of 30 to 90 $Nm^3/h$ to measure the internal pressure of the duct 10 (hereinafter, the pressure is referred to as "gage pressure").

Figure 2A:
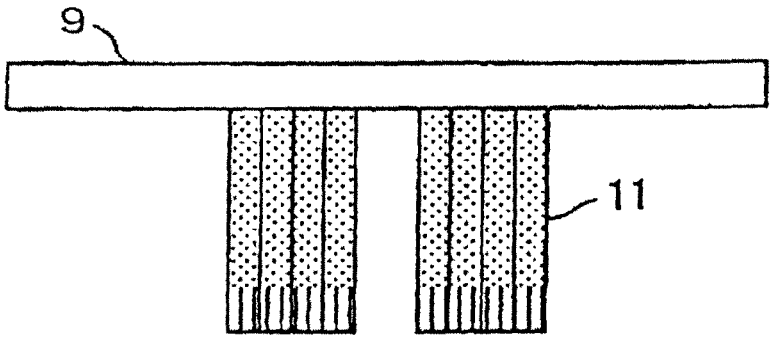
FIG. 2A and FIG. 2B show a construction of a seal curtain used in performance evaluation.
Figure 2B:
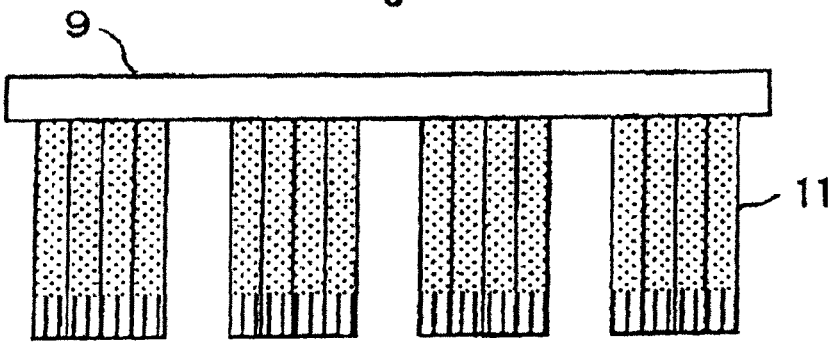

(a) Construction of Seal Curtains (the Number of Seal Curtains) and Sealing Performance The seal curtains 11 are attached to the sealing performance test apparatus to measure the duct internal pressure at a position of a cross-section A (indicated by a broken line in FIG. 1) in front of the seal curtain. The eight sheets of seal curtains (four sheets×two sets) are attached as shown in FIG. 2A, and the 16 sheets of seal curtains (four sheets×four sets) are attached as shown in FIG. 2B. That the sealing performance can be evaluated by the measurement in front of the seal curtains (cross-section A) is confirmed by an after-mentioned test (c).

Figure 3:
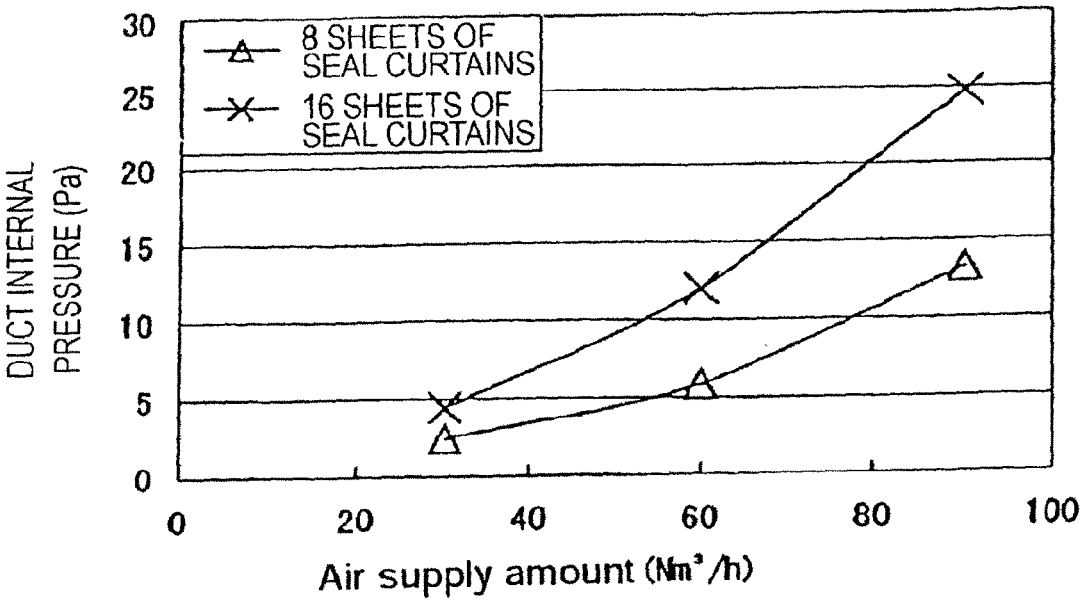
FIG. 3 shows a relationship between an air supply amount and a duct internal pressure (sealing performance) while the number of seal curtains is set to a parameter.

FIG. 3 shows test results. As is clear from the result, the duct internal pressure is improved (namely, the sealing performance is improved) as the air supply amount is increased, and the 16 sheets of seal curtains exhibit better performance than that of the eight sheets of seal curtains by a factor of about 2.

(b) Pressure Distribution in Longitudinal Direction by Seal Curtains

Using the sealing performance test apparatus, the duct internal pressure is measured at areas in front of and at the back of the seal curtain and at area between each set of seal curtains for both the case of the eight sheets of seal curtains shown in FIG. 2A and the case of the 16 sheets of seal curtains shown in FIG. 2B.

Figure 4:
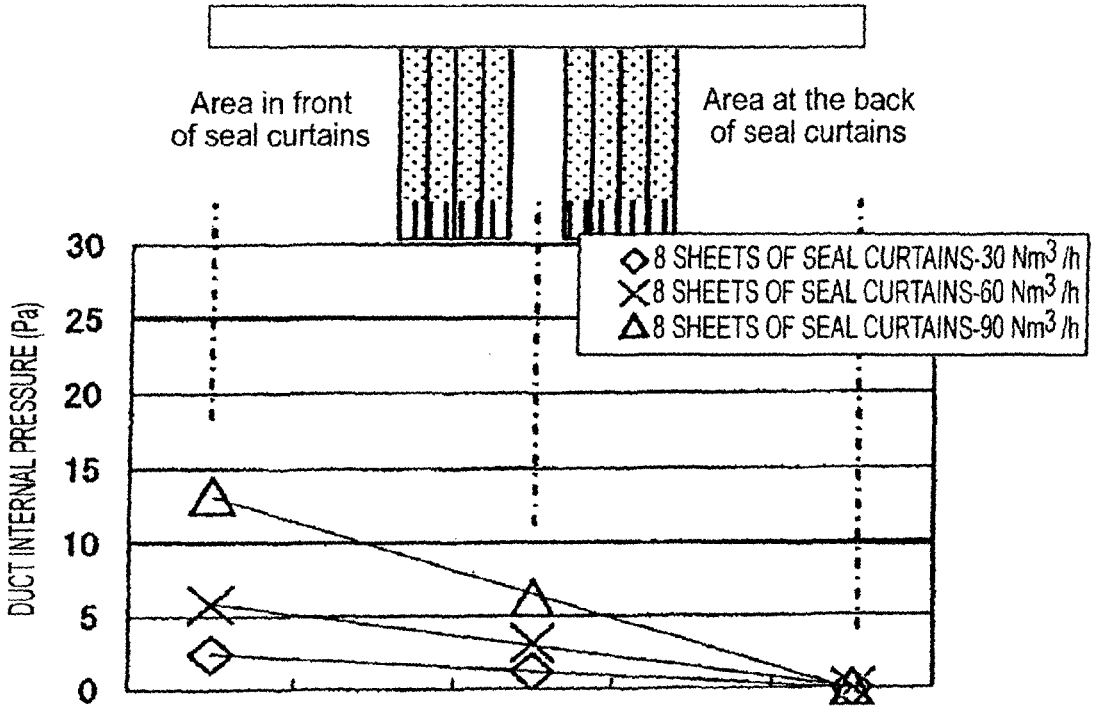
FIG. 4 shows a duct internal pressure distribution in a longitudinal direction of the seal curtains in the case of the eight sheets of seal curtains (four sheets×two sets).
Figure 5:
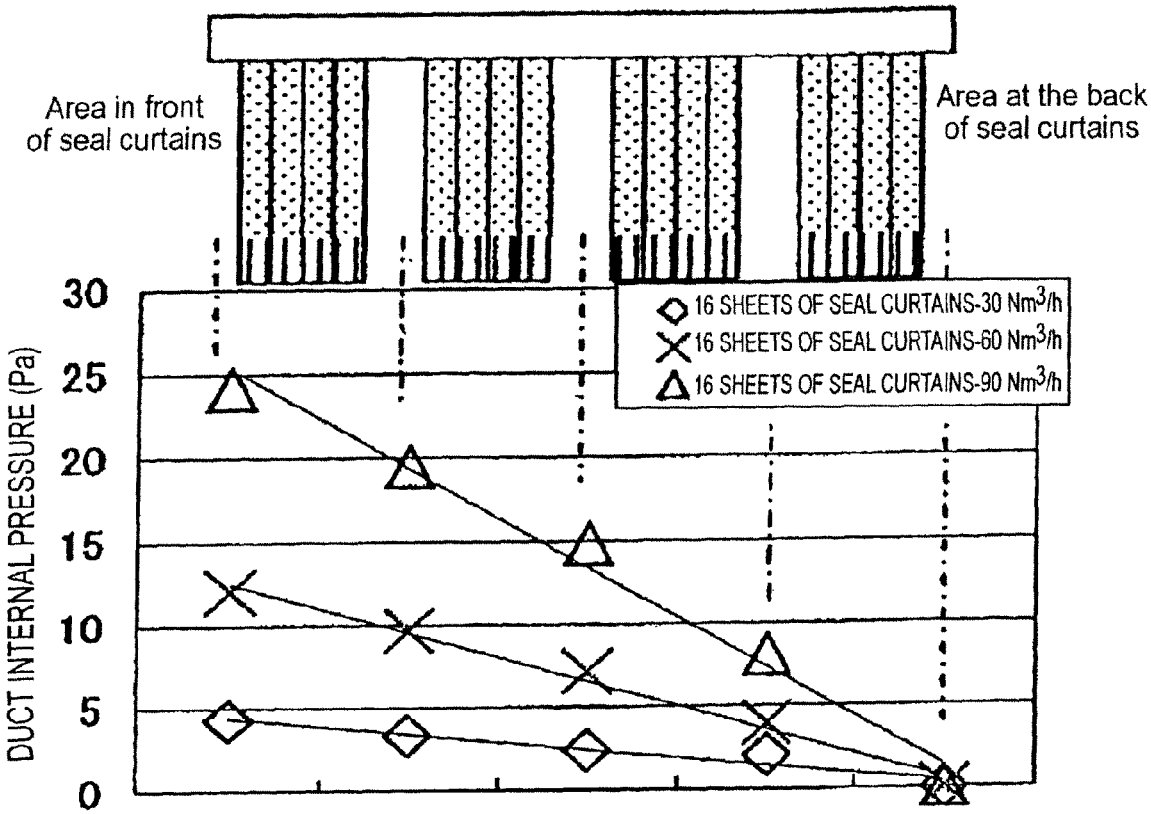
FIG. 5 shows a duct internal pressure distribution in the longitudinal direction of the seal curtains in the case of the 16 sheets of seal curtains (four sheets×four sets).

FIGS. 4 and 5 show measurement results. In FIGS. 4 and 5, the positions where the seal curtains are attached are also shown and the corresponding measurement result is shown. It can be confirmed from the results that, in both the eight sheets of seal curtains and the 16 sheets of seal curtains, the duct internal pressure is linearly raised from the area at the back of the seal curtain toward the area in front of the seal curtain and the sealing capability of about 3 Pa of pressure difference can be ensured by only one set of seal curtains in case of the air supply amount of 60 $Nm^3/h$.

(c) Uniformity of Duct Internal Pressure

Figure 6:
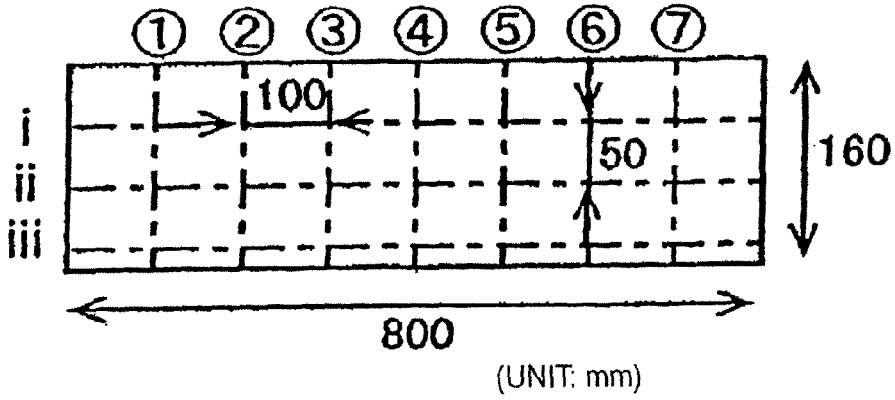
FIG. 6 shows measurement positions in a duct cross-section in a duct internal pressure uniformity evaluation test.

The pressure is measured for the case of the 16 sheets of seal curtains (four sheets×four sets) under the conditions of a pitch in a width-wise direction in the duct: 100 mm, a pitch in a height-wise direction: 50 mm (see FIG. 6), a pitch in a length-wise direction: 250 mm, and the air supply amount: 60 $Nm^3/h$.

Table 1 shows measurement results at the area in front of the seal curtains (cross section A) and Table 2 shows measurement result at the back of the seal curtains (cross section B).

TABLE 1

| | Furnace internal pressure at cross section A (Pa) | | | | | | |
|---|---|---|---|---|---|---|---|
| | 1 | 2 | 3 | 4 | 5 | 6 | 7 |
| i | 12.0 | — | — | 12.1 | — | — | 11.9 |
| ii | 12.0 | 12.0 | 12.0 | 12.0 | 12.0 | 12.0 | 11.9 |
| iii | 12.0 | — | — | 12.1 | — | — | 11.9 |

(Remarks) Air supply amount: 60 $Nm^3/h$, and seal curtains: four sheets × four sets

TABLE 2

| | Furnace internal pressure at cross section B (Pa) | | | | | | |
|---|---|---|---|---|---|---|---|
| | 1 | 2 | 3 | 4 | 5 | 6 | 7 |
| i | 0.0 | — | — | 0.0 | — | — | 0.1 |
| ii | 0.0 | 0.0 | 0.0 | 0.1 | 0.1 | 0.1 | 0.1 |
| iii | 0.0 | — | — | 0.1 | — | — | 0.1 |

(Remarks) Air supply amount: 60 $Nm^3/h$, and seal curtains: four sheets × four sets The results of Tables 1 and 2 show that the uniform pressure distribution is obtained in the duct cross sections of both the areas in front of and at the back of the seal curtains. Although not shown, it is found that the uniform pressure distribution is also obtained within ±0.1 Pa in a longitudinal direction. Because the pressure substantially becomes 0 Pa at the back of the seal curtains, it can be confirmed that the sealing performance is evaluated by measuring the pressure at the area (for example, cross section A) in front of the seal curtain.

As the results of the tests using the sealing performance test apparatus, it is found that the uniformity of the pressure at any cross section in the furnace can be ensured and the pressure is decreased in proportion to the number of seal curtains, even if a set of seal curtains is prepared in a stacking manner and then plural sets thereof are disposed. Therefore, it can be confirmed that the internal pressure of the heat treatment furnace can easily be set in two steps.

The seal curtains are used as means for forming the two-step internal pressure.

Figure 7:
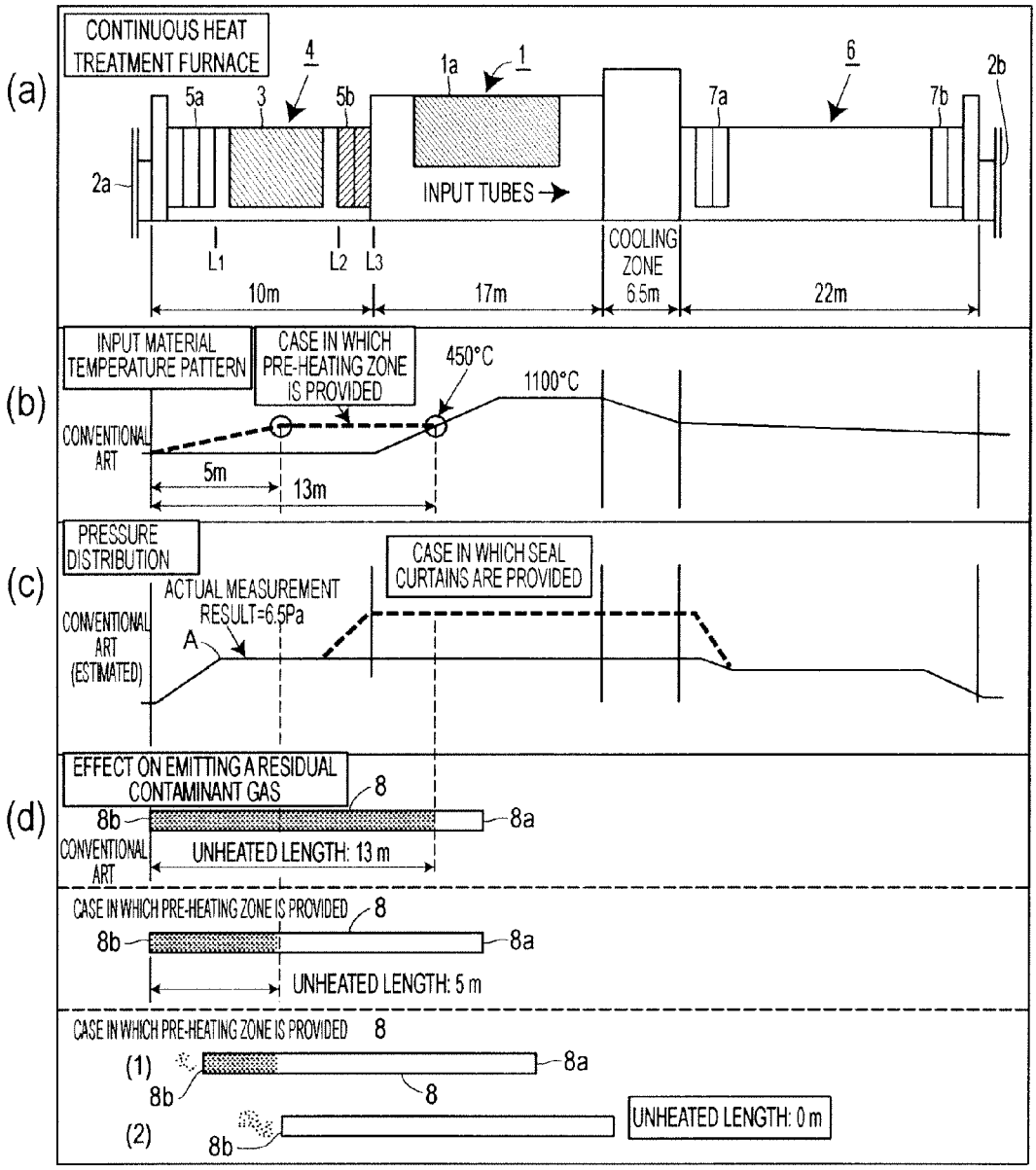
FIG. 7 schematically shows a longitudinal sectional configuration example of a continuous heat treatment furnace of the invention (FIG. 7(*a*)), an input tube temperature pattern (FIG. 7(*b*)), a furnace internal pressure distribution (FIG. 7(*c*)), and an effect on emitting a residual contaminant gas (FIG. 7(*d*)).

FIG. 7 schematically shows a longitudinal sectional configuration example of a continuous heat treatment furnace of the present invention (FIG. 7(*a*)), an input tube temperature pattern (FIG. 7(*b*)), a furnace internal pressure distribution (FIG. 7(*c*)), and an effect on emitting a residual contaminant gas (FIG. 7(*d*)). In FIG. 7, distances in a length-wise direction in FIGS. 7(*b*) to 7(*d*) correspond to those of FIG. 7(*a*).

In the heat treatment furnace shown in FIG. 7(*a*), an atmosphere-control gas is introduced to a heating chamber 1 having a heating zone 1*a*, steel tubes (input tubes) are continuously charged along an axial direction from a furnace entrance 2*a*, and the steel tubes are taken out from a furnace exit 2*b* after a predetermined heat treatment is performed. Tube conveying rollers (not shown in FIG. 7(*a*)) are disposed in a floor of the furnace from the furnace entrance 2*a* to the furnace exit 2*b*.

As shown in FIG. 7(*a*), a front chamber 4 having a preheating zone 3 is provided on the entrance side of the heating chamber 1, and seal curtains 5*a* and 5*b* defined by the present invention are attached on the entrance side and exit side (i.e., the entrance side of the heating chamber 1) of the front chamber 4 respectively. When the steel tubes moving on the tube conveying rollers travel the predetermined distance or more, a pressure difference is generated between the front chamber 4 and the outside of the continuous heat treatment furnace, with the seal curtains 5*a* being interposed therebetween, while the adhered substance in the inner surface of the steel tube is vaporized at the position where the preheating zone 3 is disposed. Therefore, the flow of the atmosphere-control gas is created from the front end toward the rear end of the steel tube, the contaminant gas generated by the vaporization is discharged along with the atmosphere-control gas to the outside of the continuous heat treatment furnace through the rear end of the steel tube. When the front end of the steel tube enters the heating chamber 1, because a pressure difference is generated between the heating chamber 1 and the front chamber 4, with the seal curtains 5*b* being interposed therebetween (or a pressure difference between the heating chamber 1 and the outside of the continuous heat treatment furnace), similarly the contaminant gas is discharged through the rear end of the steel tube to the front chamber 4 (or the outside of the continuous heat treatment furnace).

Furthermore, in the example of FIG. 7(*a*), desirably a rear chamber 6 is provided on the exit side of the heating chamber 1 while a cooling zone is interposed therebetween, and seal curtains 7*a* are attached onto the entrance side of the rear chamber 6. Therefore, an amount of atmosphere-control gas flowing in the front chamber 4 is increased and the tube feeding rate can be enhanced without generating the contamination.

In the example of FIG. 7(*a*), seal curtains 7*b* are also attached onto the exit side of the rear chamber 6. The seal curtains 7*b* are also used in the conventional art, and the seal curtains 7*b* are used to prevent the one-sided flow-out of the atmosphere-control gas from the exit side (furnace exit 2*b*) of the rear chamber 6. That is, conventionally, although the seal curtains 7*b* are attached to prevent the flow-out of the atmosphere-controls gas, the seal curtains 7*b* are not configured to cope with the abrupt internal pressure gradient of the atmosphere-control gas that can be achieved by the continuous heat treatment furnace of the present invention (in other words, the furnace internal pressure is increased and set in two steps).

The detailed description will be given with reference to FIGS. 7(*b*) to 7(*d*).

FIG. 7(*b*) shows the input tube temperature pattern, a solid line (written as "conventional art" in FIG. 7(*b*)) shows the case in which the preheating zone 3 is not provided, and a broken line shows the case where the front chamber 4 including the preheating zone 3 is provided on the entrance side of the heating chamber 1, which is of a constitutional feature of the heat treatment furnace according to the present invention. The temperature of the steel tube, can rapidly be raised to 450° C. by providing the preheating zone 3, the temperature of 450° C. being within a desirable temperature range when the adhered substance remaining in the steel tube is vaporized to generate the contaminant gas (in this case, particularly referred to as "contaminant gas" from the view point of contamination) such as the hydrocarbon type gas, chlorine gas or the like.

FIG. 7(*c*) shows the furnace internal pressure distribution (an estimated pressure distribution partially including the actual measurement values), wherein a solid line (written as "conventional art (estimated)" in FIG. 7(*c*)) shows the case in which the seal curtains 5*b* among the seal curtains 5*a* and 5*b* defined by the present invention are not attached to the front chamber 4 and the desirable seal curtains 7*a* of the present invention are not provided in the rear chamber 6. A broken line of FIG. 7(*c*) shows an inventive example of the present invention, in which the seal curtains 5*b* are provided on the exit side of the front chamber 4 (i.e., the entrance side of the heating chamber 1) and the seal curtains 7*a* are provided on the entrance side of the rear chamber 6. By this, the furnace internal pressure is enhanced between the seal curtains 5*b* and the seal curtains 7*a*, and the furnace internal pressure is set in two steps in the areas of the front chamber 4 and heating chamber 1, which allows the front chamber internal pressure to be set in the range of the furnace external pressure or more to the heating chamber pressure or less.

FIG. 7(*d*) is a view for explaining the effect on emitting the contaminant gas remaining in the steel tube. In the "conventional art" in FIG. 7(*d*), when a rear end 8*b* of a steel tube 8 is located in the entrance-side portion of the front chamber 4, and a front end 8*a* of the steel tube 8 is located near the mid-length portion of the heating chamber 1, an unheated length becomes 13 m. As used herein, the "unheated length" shall mean a length of a portion in which the adhered substance remains (or is partially vaporized) because the input tube temperature does not reach the desirable temperature (in the example, 450° C.) at which the residual adhered substance is decomposed. When compared with the furnace internal pressure distribution of FIG. 7(*c*), the gas flows in the tube at this point because the pressure at the front end 8*a* is higher than that at the rear end 8*b*. However, in feeding the steel tube 8, when the rear end 8*b* of the steel tube 8 reaches the position corresponding to a point A of FIG. 7(*c*), because the pressure difference is diminished between the front end 8*a* and rear end 8*b* of the steel tube 8, the gas flowing in the steel tube 8 is stopped and the contaminant gas remains in the steel tube 8.

In the "case in which the preheating zone is provided" as shown in FIG. 7(*d*), as is clear from comparison with the input tube temperature pattern of FIG. 7(*b*), the unheated length is decreased to 5 m because of the shorter distance between the furnace entrance 2*a* and a position at which at the input tube temperature reaches 450° C. However, when the rear end 8*b* reaches the position corresponding to the point A of FIG. 7(*c*), the gas flowing in the steel tube 8 is stopped and the contaminant gas remains near the rear end 8*b* in the steel tube 8 as similar as described above.

In the "case in which the preheating zone and seal curtains are provided" as shown in (1) of FIG. 7(*d*), the rear end 8*b* of the steel tube 8 reaches the position corresponding to the point A of FIG. 7(*c*), and the front end 8*a* is located near the length-wise middle portion of the heating chamber 1. The unheated length is further decreased compared with the "case in which the preheating zone is provided". The seal curtains 5*b* are provided on the exit side of the front chamber 4 (i.e., the entrance side of the heating chamber 1), and the heat treatment furnace internal pressure is set in two steps as shown in FIG. 7(*c*). As the result, even if the rear end 8*b* of the steel tube 8 reaches the position corresponding to the point A of FIG. 7(*c*), the pressure difference exists between the front end 8*a* and rear end 8*b* of the steel tube 8, and the gas flows in the steel tube 8, whereby the vaporized contaminant gas does not remain in the steel tube 8. When the steel tube 8 is further fed to become a state of (2), the rear end 8*b* of the steel tube 8 also reaches 450° C., the unheated length becomes 0 m, and all the adhered substances remaining in the steel tube 8 are decomposed and vaporized. Additionally, as is clear from the comparison with the furnace internal pressure distribution of FIG. 7(*c*), the vaporized contaminant gas is discharged from the rear end of the tube by the gas flowing in the tube.

There is no particular limitation to a source material and shape of the seal curtain. The conventional heat-resistant curtain can be used as the seal curtain in the embodiment. As shown in the experimental result, the plural sheets of curtains are stacked to be one set and the plural sets are used, which allows the pressure difference to be effectively maintained between the front side and rear side of the seal curtains.

Thus, in the continuous heat treatment furnace of the present invention, even if the post-cold working washing process is performed only by the alkali degreasing and washing, the adhered substance to the inner and outer surfaces of the steel tube can easily be removed before the heat treatment, and the required facility investment becomes a relatively low level.

The metal tube described in the above (2) is the one produced using the heat treatment furnace of the present invention. Even if the post-cold working washing process is performed only by the alkali degreasing and washing, the adhered substance remaining in the inner and outer surfaces of the metal tube is removed in the preheating zone before the metal tube is heated to the high temperature (in an example shown in FIG. 7, 1100° C.) by the heat treatment, so that the metal-tube surface (particularly, inner surface) is not contaminated.

The heat treatment method described in the above (3) is "a heat treatment method in which an atmosphere-control gas is introduced to a heating chamber having a heating zone, metal tubes are continuously charged along an axial direction from a furnace entrance, and the metal tube subjected to a heat treatment is taken out from a furnace exit, the heat treatment method including: setting an internal pressure of a front chamber including a preheating zone on an entrance side of the heating chamber in the range of a furnace external pressure or more to a heating chamber pressure or less; and performing the heat treatment by heating the metal tube to a temperature at which an adhered substance remaining on inner and outer surfaces of the metal tube can be vaporized in the front chamber."

In the case where surface oxidation of the tube is to be suppressed, a non-oxidizing gas such as hydrogen or nitrogen, otherwise an inert gas such as He or Ar is used, alone or in combination, as the "atmosphere-control gas". In the case where a dense oxidized coating film having high adhesion property is to be formed to ensure a corrosion-resistant property on the tube surface, water vapor, an oxidizing gas such as vapor, $CO_2$ and $O_2$, or a mixed gas with the non-oxidizing gas, is used as the "atmosphere-control gas". In addition to the above-described gases, the use of a combustion exhaust gas of air and LNG which is of a fuel can reduce the heat treatment cost.

As to the temperature in "heating the metal tube to a temperature at which an adhered substance can be vaporized", desirably the inner surface temperature of the tube is set in the range of 400° C. or more to 750° C. or less. In order to effectively decompose and vaporize the residual adhered substance, preferably the tube surface is heated to the temperature of 400° C. or more. In order to mitigate the action of the contaminant gas, or in order to prevent the generation of the carburizing, the tube surface is heated to the temperature of 750° C. or less in consideration of the control accuracy.

The "setting an internal pressure of a front chamber in the range of a furnace external pressure or more to a heating chamber pressure or less" can be achieved by introducing a proper supply amount of atmosphere-control gas into the heating chamber. The seal curtains 5*b* provided on the exit side of the front chamber and the seal curtains 5*a* provided on the entrance side of the front chamber act effectively to set the front chamber internal pressure in the range of the furnace external pressure or more to the heating chamber pressure or less.

The heat treatment method can be implemented by the heat treatment furnace of the present invention. That is, the furnace internal pressure is set in two steps wherein step 1 is for the front chamber and step 2 for the heating chamber, so that the front chamber internal pressure can be set in the range of the furnace external pressure or more to the heating chamber pressure or less. Therefore, the flow of the atmosphere-control gas is naturally created from the front end to the rear end in the tube, so that the adhered substance remaining in the tube can be vaporized, replaced and removed by the atmosphere-control gas. Then, because the heat treatment is performed at a predetermined temperature continuously, the heat treatment efficiency is not lowered.

EXAMPLES

Using an "isothermal flow model equation" expressing the flow in the tube where a pressure difference of $\Delta P_P$ [Pa] is generated between opposite ends, whether or not the gas in the tube can be discharged is studied when the steel tube having an inner diameter of 6 mm and a length of 20 m is fed while installation conditions of the preheating zone and seal curtains are varied. Additionally, the presence or absence of the contamination of the inner surface of the tube, caused by the adhered substance containing chlorine, is investigated in the actual furnace. The furnace internal pressure distribution necessary to study whether or not the gas in the tube can be discharged is estimated by an after-mentioned estimation equation of furnace internal pressure distribution.

Derivation of "Isothermal Flow Model Equation":

The pressure difference $\Delta P_P$ [Pa] generated at opposite ends of the tube and a gas flow rate $v_P$ [m/s] generated in the tube have a relationship of the following equation (1).

[Formula 1]

$$\Delta P_P = \lambda_P \frac{L_P}{D_P} \frac{1}{2} \rho v_P^2 \tag{1}$$

where $\lambda_P$: tube friction coefficient [−]

$L_P$: tube length [m]

$D_P$: tube diameter [m]

$\rho$: gas density [kg/m$^3$]

$v_P$: gas flow rate [m/s]

In the case of a laminar flow, the tube friction coefficient is obtained by the following equation (2).

[Formula 2]

$$\lambda_P = \frac{64}{Re} = 64\frac{\mu}{\rho D_P v_P} \tag{2}$$

where Re: Reynolds number [−]

μ: viscosity [kg/m·s]

Therefore, $\Delta P_P$ [Pa] is expressed by the following equation (3).

[Formula 3]

$$\Delta P_P = 32\frac{\mu L_P}{D_P^2} v_P \tag{3}$$

On the other hand, assuming that L is zero at the entrance of the front chamber, $L_1$ is a length reference position designating a length to the position at the rear end of the seal curtains disposed on the entrance side of the front chamber, $L_2$ and $L_3$ are length reference positions designating lengths to positions at the front end and rear end of the seal curtains disposed on the exit side of the front chamber respectively, and $L_3$ is equal to $L_2$+"thickness of seal curtains 5*b*" (see FIG. 7(*a*)), the furnace internal pressure distribution is expressed by the following equation (4), when a static pressure is linearly increased between the areas in front of and at the back of the seal curtains while being equal between the seal curtains.

[Formula 4]

$$\Delta P_P(L) = P_{oven}(L) - P_{oven}(L - L_P). \tag{4}$$

where

L: length to tube front end position in furnace relative to entrance of front chamber [m]

$L_P$: entire length of tube [m]

$P_{oven}$: furnace internal pressure [Pa]

At this point, it is assumed that the contaminant gas is generated (the contaminant substance adhering to the inner surface of the tube is vaporized) when the steel tube reaches the temperature of 450° C. Assuming that $L_{450}$ is a length reference position representing a length to the position of the steel tube in the furnace when the front end of the steel tube reaches the temperature of 450° C., $t_{450}$ is time when the front end (end portion in the tube conveying direction) of the steel tube arrives at $L_{450}$, and $t_4$ is time when the front end of the steel tube arrives at the position $L_4$ ($L_4 = L_3 + L_P$, $L_P$ is an entire length of the tube) where the pressure difference is eliminated between opposite ends of the steel tube, a distance $L_{drain}(\mathbf{0})$ in which the atmosphere-control gas located at the front-end position of the steel tube is moved during the time interval ($t_4$-$t_{450}$) is expressed by the following equation (5).

[Formula 5]

$$L_{drain}(0) = \int_{t450}^{t4} v_P dt \tag{5}$$

Assuming that $v_t$ is a tube feeding rate, because of $L = t \cdot v_t$, the equation (5) is expressed by the following equation (6).

[Formula 6]

$$L_{drain}(0) = \frac{1}{v_t}\int_{LA50}^{LA} v_P \, dL = \frac{D_P^2}{32\mu L_P v_t}\int_{LA50}^{LA} \Delta P_P(L)\, dL \tag{6}$$

The distance $L_{drain}(x)$, in which the gas located at a distance x [m] in the tube from the front end of the steel tube is moved in the steel tube until the tube is fed to the position $L_4$ where the pressure difference is diminished between opposite ends of the steel tube since the steel tube reaches the temperature of 450° C., is expressed by the following equation (7).

[Formula 7]

$$L_{drain}(x) = \frac{D_P^2}{32\mu L_P v_t}\int_{LA50+x}^{LA} \Delta P_P(L)\, dL \tag{7}$$

where

Accordingly, the unheated length $L_{res}$ is expressed by the following equation (8).

[Formula 8]

$$L_{res} = \mathrm{Max}\{(L_P - x) - L_{drain}(x)\} \tag{8}$$

Where $0 \le x \le L_P$

In the case of $L_{res} \le 0$, "unheated length is disappeared", namely, the atmosphere-control gas can be discharged from the inside of the tube, and the contaminant gas is also discharged along with the atmosphere-control gas from the inside of the tube.

Estimation Equation of Furnace Internal Pressure Distribution:

A gas mass flow rate G [kg/s] and static change $\Delta P_j$ [Pa] of the gas flowing out from the j-th seal curtain are expressed by the following equations (9) and (10).

[Formula 9]

$$G = \rho_j A v_j \tag{9}$$

$$\Delta P_j = \zeta \frac{1}{2}\rho_j v_j^2 \tag{10}$$

where

A: cross-sectional area of gas passing portion of curtain [$m^2$]

$\Delta P_j$: pressure difference between portions in front of and at the back of curtain [Pa]

ζ: resistance coefficient per curtain [−]

$\rho_j$: average gas density between areas in front of and at the back of curtain [$kg/m^3$]

$\rho_j$: average gas passing rate of curtain sectional area [m/s]

A pressure difference $\Delta P_{total}$ [Pa] generated when the gas passes through n sheets of seal curtains is obtained from the following equation (11).

[Formula 10]

$$\Delta P_{total} = n\zeta\frac{1}{2}\rho v^2 = n\zeta\frac{1}{2}\rho\left(\frac{G}{\rho A}\right)^2 = Z\frac{G^2}{2\rho} \tag{11}$$

where ρ and ν are constant values and $Z = n\zeta/A^2$ [$m^{-z}$]

Assuming that $N_{en\text{-}in}$, $N_{en\text{-}out}$, and $N_{ex}$ [set] are the numbers of sets (one set=four sheets) of the seal curtains installed in the entrance side of the front chamber, the exit side of the front chamber, and the rear chamber respectively and $G_{en}$ and $G_{ex}$ [kg/s] are amounts of hydrogen gas flowing out from the front chamber side and rear chamber side respectively, the equation

(12) is obtained from the relationship of heating zone static pressure $\Delta P_{H_zone}$=cooling zone static pressure.

[Formula 11]

$$\Delta P_{H_Zone} = N_{en\text{-}in} Z \frac{G_{en}^2}{2\rho_{en\text{-}in}} + N_{en\text{-}out} Z \frac{G_{en}^2}{2\rho_{en\text{-}out}} = N_{ex} Z \frac{G_{ex}^2}{2\rho_{ex}} \quad (12)$$

At this point, letting $G_{total}=G_{en}+G_{ex}$, the equations (13) and (14) are obtained.

[Formula 12]

$$G_{en} = \frac{\left(\frac{N_{ex}}{\rho_{ex}}\right)^{1/2}}{\left(\frac{N_{en\text{-}in}}{\rho_{en\text{-}in}} + \frac{N_{en\text{-}out}}{\rho_{en\text{-}out}}\right)^{1/2} + \left(\frac{N_{ex}}{\rho_{ex}}\right)^{1/2}} G_{total} \quad (13)$$

$$G_{ex} = \frac{\left(\frac{N_{en\text{-}in}}{\rho_{en\text{-}in}} + \frac{N_{en\text{-}out}}{\rho_{en\text{-}out}}\right)^{1/2}}{\left(\frac{N_{en\text{-}in}}{\rho_{en\text{-}in}} + \frac{N_{en\text{-}out}}{\rho_{en\text{-}out}}\right)^{1/2} + \left(\frac{N_{ex}}{\rho_{ex}}\right)^{1/2}} G_{total} \quad (14)$$

The heating zone static pressure (i.e., heating chamber pressure) $\Delta P_{H_zone}$, is obtained when the number of sets of the seal curtains and the total hydrogen supply amount $G_{total}$ are given from the equation (12) to (14). A front chamber pressure $\Delta P_{front\ chamber}$ can also be determined by the following equation (15).

[Formula 13]

$$\Delta P_{front\ chamber} = N_{en\text{-}in} Z \frac{G_{en}^2}{2\rho_{en\text{-}in}} \quad (15)$$

Simulation Result (Study Result on Whether or not Gas in Tube Can be Discharged):

Assuming that the heat treatment is performed to the steel tube having an inner diameter of 6 mm and a length of 20 m, the unheated length $L_{res}$ is computed using the "isothermal flow model equation". As described above, when the unheated length $L_{res}$ is zero or less, the contaminant gas in the tube is discharged from the rear end of the tube. At this point, an average temperature of 775° C. of the temperatures ranging from 450 to 1100° C. in the heat treatment furnace is adopted as the temperature inside the tube.

In the simulation, assuming that the tube feeding rate is 1450 mm/min or 950 mm/min, the computation is performed for five cases, i.e., the case in which the preheating zone and exit-side seal curtains are not provided in the front chamber and the entrance-side seal curtains are not provided in the rear chamber (simulation 1), the case in which only the preheating zone is provided in the front chamber (simulation 2), the case in which only the exist-side seal curtain provided in the front chamber (simulation 3), the case in which the preheating zone and exit-side seal curtains are provided in the front chamber (simulation 4), and the case in which the preheating zone and exit-side seal curtains are provided in the front chamber and the entrance-side seal curtains are provided in the rear chamber (simulation 5).

Table 3 shows simulation results. In addition to the unheated length $L_{res}$ Table 3 also shows setting conditions such as the presence or absence of the preheating zone or seal curtains on facilities in the continuous heat treatment furnace, along with the pressures of the front chamber and heating chamber. The mark of "○" in columns of "front chamber" and "rear chamber" of the heat treatment furnace indicates that the heat treatment furnace includes the preheating zone or the seal curtains. The mark of "○" in the column of "unheated length $L_{res}$" indicates that the contamination can be prevented in the inner surface of the tube in simulation estimation, and the mark of "x" indicates that the contamination cannot be prevented in simulation estimation.

TABLE 3

| | Setting conditions in continuous heat treatment furnace | | | | | | | | | | | | | |
|---|---|---|---|---|---|---|---|---|---|---|---|---|---|---|
| | Front chamber | | | | | | | | Furnace internal pressure (Pa) | | Unheated length Lres (m) Pipe conveying rate | | | |
| | Exit-side seal | Pre-heating | Rear chamber Entrance-side seal | $L_1$ | $L_2$ | $L_3$ | $L_4$ | $L_{450}$ | Front | Heating | 1450 mm/min | | 950 mm/min | |
| Simulation | curtain | zone | curtain | (m) | (m) | (m) | (m) | (m) | chamber | chamber | | Evaluation | | Evaluation |
| 1 | — | — | — | 2.7 | 8.7 | 9.9 | 27.0 | 13.0 | 6.78 | 6.78 | 13.2 | X | 10.4 | X |
| 2 | — | ○ | — | 2.7 | 8.7 | 9.9 | 27.0 | 7.0 | 6.78 | 6.78 | 8.3 | X | 4.3 | X |
| 3 | ○ | — | — | 2.7 | 8.7 | 9.9 | 27.0 | 13.0 | 4.82 | 9.64 | 7.1 | X | 4.5 | X |
| 4 | ○ | ○ | — | 1.7 | 8.7 | 9.9 | 27.0 | 5.0 | 4.82 | 9.64 | 0.6 | X | −3.4 | ○ |
| 5 | ○ | ○ | ○ | 1.7 | 8.7 | 9.9 | 27.0 | 5.0 | 6.24 | 12.47 | −2.4 | ○ | −5.4 | ○ |

As is clear from the result shown in Table 3, in the simulation 4 in which the preheating zone and exit-side seal curtains are provided in the front chamber, the unheated length becomes 0 or less ($L_{res}$<=0) in the case of the slow tube feeding rate (950 mm/min). That is, it is predicted that the contaminant gas can be discharged from the inside of the tube. In the simulation 5 in which the preheating zone and exit-side seal curtains are provided in the front chamber and the entrance-side seal curtains are provided in the rear chamber, the unheated length becomes zero or less in spite of the fast tube feeding rate (1450 mm/min), and it is predicted that the heat treatment can be performed more efficiently.

Investigation on Presence or Absence of Contamination of Inner Surface of Tube in Actual Furnace:

Subsequent to the simulations, the presence or absence of the contamination by chlorine is investigated by performing the heat treatment for the steel tube (inner diameter of 6 mm and length of 20 m) in which the lubricant containing chlorine adheres to the inner and outer surfaces using the actual furnace. The hydrogen gas is used as the atmosphere-control gas in the heat treatment furnace, and the hydrogen gas is supplied to the heating chamber while the supply amount is set to 95.00 $Nm^3/h$. The tube feeding rate is set to 950 m/min or 1450 m/min.

Table 4 shows investigation results. In Table 4, the curtains for general use are used as the seal curtains on the entrance side of the front chamber, and the seal curtains on the entrance side of the front chamber are not shown because the seal curtains on the entrance side of the front chamber are provided in both Comparative Example and Inventive Example. As to the "presence or absence of contamination", the rear-end portion (the portion becoming the rear-end side relative to the steel tube feeding direction) in which the chlorine likely remains particularly is cut out from the steel tube after the heat treatment, the chlorine adhering to the inner surface of the steel tube is extracted by pure water, and ion chromatography is performed to the extracted water to analyze the residual chlorine amount in the inner surface of the tube.

TABLE 4

| | Seal curtain on exit side of front chamber | Pre-heating zone (350 KW) | Seal curtain on entrance side of rear chamber | Hydrogen supply amount ($Nm^3/h$) Total input amount | Front chamber flow-out | Rear chamber flow-out | Furnace internal pressure (Pa) Front chamber | Heating chamber | Pipe conveying rate (m/min) | Presence or absence of contamination |
|---|---|---|---|---|---|---|---|---|---|---|
| Comparative example 1 | — | — | — | 95.0 | 41.31 | 53.69 | 6.78 | 6.78 | 950 | Presence |
| Comparative example 2 | — | Installed | — | 95.0 | 41.31 | 53.69 | 6.78 | 6.78 | 950 | Presence |
| Comparative example 3 | Installed | — | — | 95.0 | 34.09 | 60.91 | 1.82 | 8.73 | 950 | Presence |
| Example 1 | Installed | Installed | — | 95.0 | 34.09 | 60.91 | 1.82 | 8.73 | 950 | Absence |
| Example 2 | Installed | Installed | — | 95.0 | 34.09 | 60.91 | 1.82 | 8.73 | 1450 | Trace |
| Example 3 | Installed | Installed | Installed | 95.0 | 39.85 | 55.15 | 2.49 | 11.93 | 1450 | Absence |

As is clear from the result shown in Table 4, in Comparative Examples 1 to 3 which base conditions deviated from those defined by the present invention, it is sentenced that the contamination occurs. On the other hand, in Inventive Examples 1 and 3, it is confirmed that the contamination is absent, or it turns out that the contamination is the least (Inventive Example 2).

The slight contamination being observed in Inventive Example 2 is presumably attributed to the fact that the tube feeding rate is higher than that of Inventive Example 1 under otherwise similar conditions, the replacement of the contaminant gas with the atmosphere-control gas inside the tube is delayed, and the contaminant gas remains near the rear end of the tube. The contamination is not observed in Inventive Example 3 in spite of the fast tube feeding rate. This is attributed to the fact that, as a result of installation of the seal curtains on the entrance side of the rear chamber, the heating chamber internal pressure is enhanced from 8.73 Pa to 11.93 Pa to increase the amount of atmosphere-control gas flowing in the front chamber, and the gas replacement is promoted inside the tube to remove the contaminant gas.

INDUSTRIAL APPLICABILITY

According to the continuous heat treatment furnace and heat treatment method of the present invention, even if the post-cold working washing process is performed only by the alkali degreasing and washing, the adhered substance to the inner and outer surfaces of the metal tube can easily be removed before the heat treatment. Accordingly, the continuous heat treatment furnace and heat treatment method of the present invention can suitably applied to the production of metal tubes, such as a stainless steel tube and a nickel-chromium-iron alloy tube, which are cold-worked using the rolling oil or lubricant containing the hydrocarbon component.

What is claimed is:

1. A heat treatment method in which an atmosphere-control gas is introduced to a heating chamber having a heating zone, metal tubes are continuously loaded along an axial direction from a furnace entrance, and the metal tubes subjected to a heat treatment are taken out from a furnace exit, the heat treatment method comprising:

providing a front chamber including a preheating zone on an entrance side of the heating chamber, the front chamber having seal curtains both at the entrance thereof and at the exit therefrom, setting an internal pressure of a front chamber at a pressure that is greater than atmospheric pressure owing to the in-between entrance seal curtains, but less than the heating chamber pressure owing to the in-between exit seal curtains, so that two levels of pressure are defined inside the furnace to provide a stepwise pressure gradient therein;

performing the heat treatment for the metal tubes by heating the metal tubes to a temperature at which an adhered substance on inner and outer surfaces of the metal tubes can be vaporized in the front chamber to produce a contaminant gas and discharging the contaminant gas inside the metal tube to outside of the continuous heat treatment furnace through the rear end of the metal tube as a result of the pressure gradient between the front chamber and outside the continuous heat treatment furnace, and discharging the contaminant gas inside the metal tube through the rear end of the metal tube to the front chamber as a result of the pressure gradient between the heating chamber and the front chamber.

2. The heat treatment method according to claim 1, wherein the inner and outer surfaces of the metal tubes is heated at a temperature in the range of 400° C. or more to 750° C. or less, when the metal tubes are heated to a temperature at which an adhered substance remaining in inner and outer surfaces of the metal tubes can be vaporized.

3. The heat treatment method according to claim 1, wherein the heat treatment is performed for the metal tubes after cold working.

* * * * *

UNITED STATES PATENT AND TRADEMARK OFFICE

CERTIFICATE OF CORRECTION

PATENT NO. : 8,641,841 B2
APPLICATION NO. : 12/651064
DATED : February 4, 2014
INVENTOR(S) : Tatsuoka et al.

It is certified that error appears in the above-identified patent and that said Letters Patent is hereby corrected as shown below:

On the Title Page

At Item [75] Inventor,

Akhiro Sakamoto, Chiba (JP) should be

--Akihiro Sakamoto, Chiba (JP)--

Signed and Sealed this
Tenth Day of June, 2014

Michelle K. Lee

Michelle K. Lee
*Deputy Director of the United States Patent and Trademark Office*